United States Patent [19]

Ikeda

[11] Patent Number: 5,045,003

[45] Date of Patent: Sep. 3, 1991

[54] WATER JET PROPELLING SYSTEM

[75] Inventor: Kenji Ikeda, Hamamatsu, Japan

[73] Assignee: Sanshin Kogyo Kabushiki Kaisha, Hamamatsu, Japan

[21] Appl. No.: 387,900

[22] Filed: Aug. 1, 1989

[30] Foreign Application Priority Data

Aug. 3, 1988 [JP] Japan ..... 63-192802

[51] Int. Cl.[5] ..... B63H 11/00

[52] U.S. Cl. ..... 440/042; 440/40

[58] Field of Search ..... 440/38, 40, 42, 47, 440/49, 66, 67; 114/144 R, 150, 151

[56] References Cited

U.S. PATENT DOCUMENTS

| | | | |
|---|---|---|---|
| 1,629,767 | 5/1927 | Valdes | 440/42 |
| 3,003,455 | 10/1961 | Alexander | 440/42 |
| 3,780,691 | 12/1973 | Stelling | 440/42 |
| 3,935,833 | 2/1976 | Onal | 440/42 |
| 3,957,207 | 5/1976 | Chronic | 440/42 |
| 4,239,013 | 12/1980 | Haynes | 440/40 |
| 4,652,244 | 3/1981 | Drury | 440/40 |

*Primary Examiner*—Joseph F. Peters, Jr.
*Assistant Examiner*—Clifford T. Bartz
*Attorney, Agent, or Firm*—Ernest A. Beutler

[57] ABSTRACT

A number of embodiments of steering nozzles for jet propulsion watercraft that are configured so as to achieve different steering effects to suit particular watercraft or rider's preferences. The different steering effect is achieved through the use of varying the shape of the discharge opening of the steering nozzle.

6 Claims, 5 Drawing Sheets

WATER JET PROPELLING SYSTEM

BACKGROUND OF THE INVENTION

This invention relates to a water jet propelling system and more particularly to an improved steering nozzle arrangement for a jet propulsion unit for a watercraft.

The use of so called "jet propulsion units" for powering watercraft is well known and such power units are widely used. Normally the jet propulsion unit includes a pumping unit that has a water inlet, a rotating impeller, and a discharge nozzle or opening through which the water is discharged. Pivotally mounted relative to the discharge nozzle is a steering nozzle which is steered by the operator so as to change the direction of travel of the watercraft. The steering nozzles previously proposed all have a discharge opening that lies in a common vertical plane and which is generally circular in shape. As a result, when executing a turn the discharge nozzle tends to create a force on the watercraft which, in addition to effecting steering movement, tends to cause the watercraft to side slip. Although side slipping may be desirable under some circumstances, for operator enjoyment or for more precise control, it may be desired to provide different types of effect upon steering of the nozzle.

It is, therefore, a principal object of this invention to provide an improved water jet propelling system.

It is a further object of this invention to provide an improved steering nozzle for a jet propulsion unit for a watercraft that can be tailored to obtain the desired type of performance for a given craft or a desired riding and handling characteristic.

SUMMARY OF THE INVENTION

This invention is adapted to be embodied in a jet propulsion unit for propelling and steering a watercraft having a pumping unit for collecting water from an inlet and expelling the water through a discharge. A steering nozzle is pivotally supported adjacent the discharge and is adapted to collect water discharged from the discharge and return it to the body of water in which the watercraft is operated. The steering nozzle is pivotal about a generally vertically extending axis. Means are provided for generating a side force on the steering nozzle when the nozzle is pivoted from its straight ahead position which force is not perpendicular to the steering axis.

DETAILED DESCRIPTION CF THE PREFERRED EMBODIMENTS OF THE INVENTION

Figure 1:
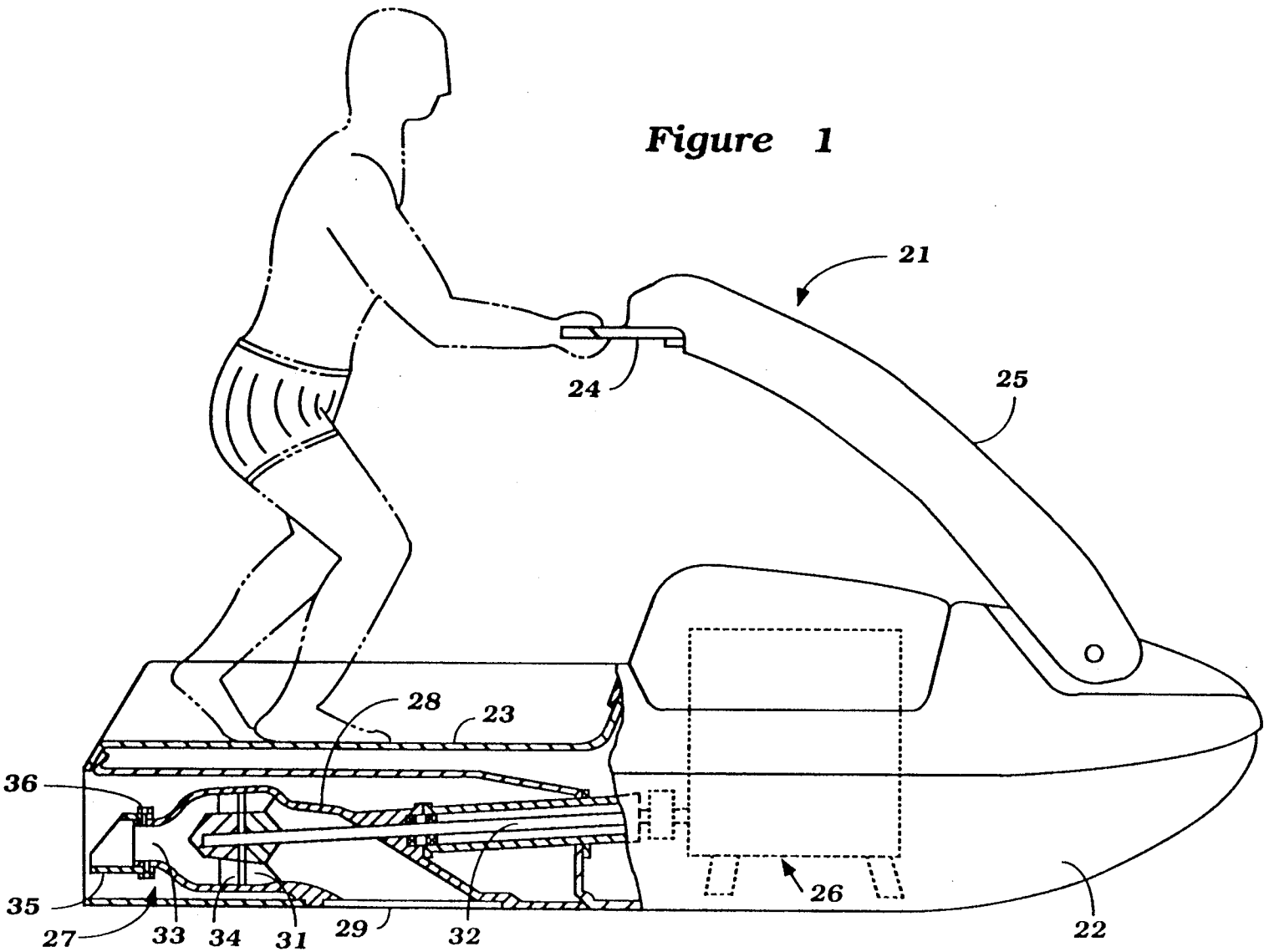
FIG. 1 is a side elevational view of a small watercraft powered by a jet propulsion unit constructed in accordance with an embodiment of the invention.
Figure 2:
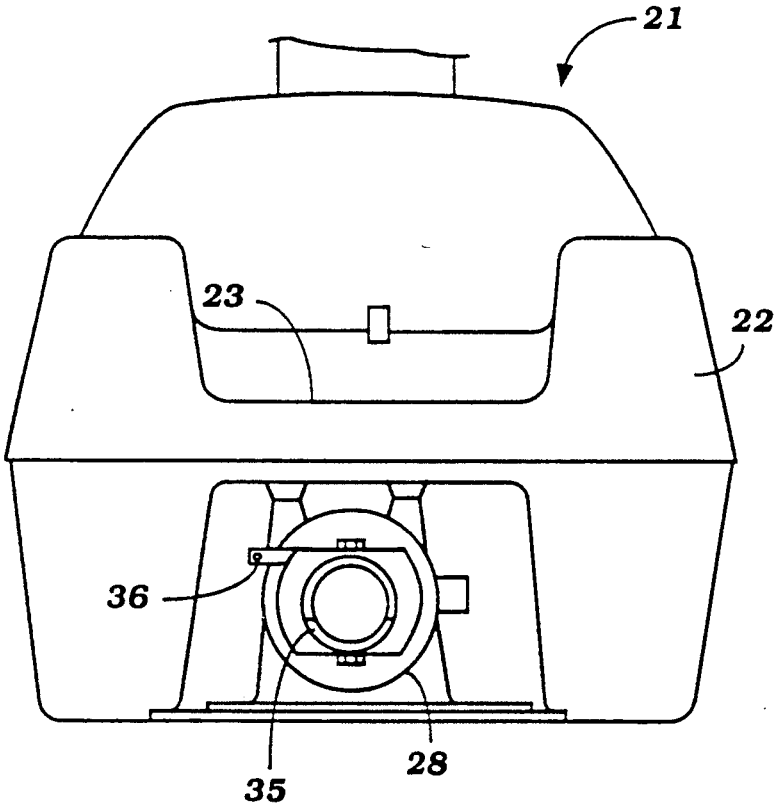
FIG. 2 is a rear elevational view of the watercraft.

Referring first to FIGS. 1 and 2, a small jet propelled watercraft constructed in accordance with an embodiment of the invention is identified generally by the reference numeral 21. The watercraft 21 is, in the illustrated embodiment, the type that is designed to be operated by a single operator standing on or kneeling on the watercraft. It is to be understood, however, that the invention can be utilized in conjunction with a wide variety of other types of jet propelled watercraft. However, the type of watercraft depicted is one in which the invention has particular utility because of its sporting nature.

The watercraft 21 is comprised of a hull 22 that provides a rider's deck 23 on which a rider may stand. The rider can steer the watercraft, in a manner to be described by operating a steering handle bar 24 that is supported on a pivotal mast 25 and connected to the steering mechanism which will be described.

Positioned forwardly of the rider's area 23 and confined within the hull is an engine bay in which an internal combustion engine 26 which may be of any known type is contained. The engine 26 drives a jet propulsion unit, indicated generally by the reference numeral 27 and which, except for its steering nozzle (to be described) may be of any known type. Basically, the jet propulsion unit 27 includes a pumping unit having an outer housing 28 that draws water from the body of water in which the watercraft is operating through a downwardly facing water inlet 29. An impeller 31 is affixed for rotation with a drive shaft 32 that is coupled to the output shaft of the engine 26 for drawing the water through the inlet 29 and discharging it toward a discharge nozzle 33 after it has passed through a series of straightening vanes 34.

A steering nozzle 35 is pivotally supported so that its inlet opening is in registry with the outlet of the discharge nozzle 33. Pivot pins 36 support the steering nozzle 35 for rotation about a generally vertically extending axis. The steering nozzle 35 has affixed to it a steering lever 36 that is connected by means of a Boden wire cable or the like to the handle bar 24 for its steering movement in a well known manner.

Figure 3:
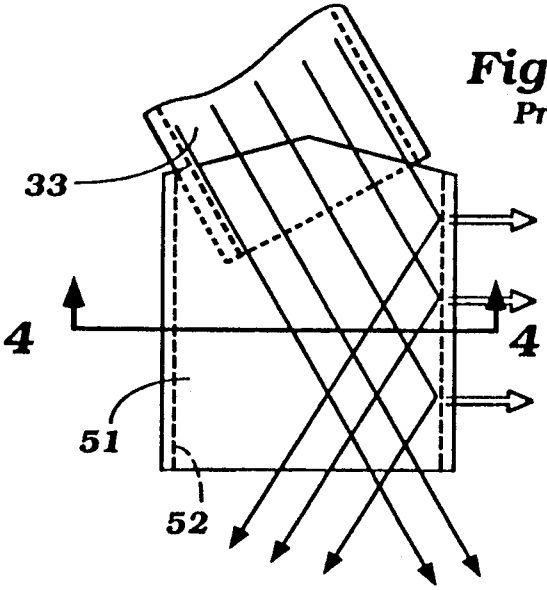
Figure 3 Prior Art
FIG. 3 is a top plan view of a steering nozzle constructed in accordance with the prior art type of construction and shows the operation during steering.
Figure 4:
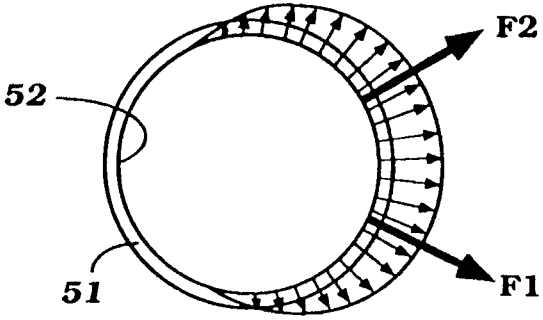
Figure 4 Prior Art
FIG. 4 is a cross-sectional view taken along the line 4—4 of FIG. 3 and shows the force distribution on the steering nozzle during steering movement.
Figure 9:
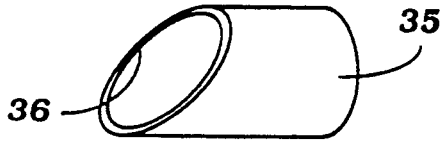
FIG. 9 is a perspective view showing the steering nozzle constructed in accordance with the embodiment of FIGS. 6 through 8.
Figure 5:
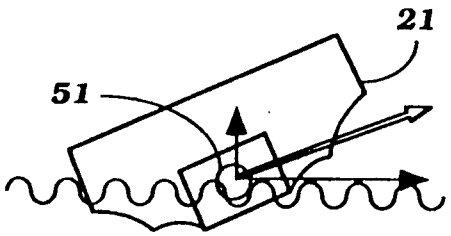
Figure 5 Prior Art
FIG. 5 is a rear elevational view of a watercraft being steered by a steering nozzle of the prior art type shown in FIGS. 3 and 4.

With conventional prior art types of constructions, the steering nozzle has a generally cylindrical shape with a vertically extending discharge opening. The effect of such a configuration may be best understood by reference to FIGS. 3 through 5 wherein the steering nozzle, indicated in this figure by the reference numeral 51, is steered relative to the discharge nozzle 33 so as to effect a right hand turn. Because of the fact that the nozzle 51 has a circular discharge opening 52 the force distribution on it will be as shown in FIG. 4. That is, the forces are distributed generally in an equal pattern about a plane that extends perpendicular to the steering nozzle axis. As a result, as seen in FIG. 5, when steering is being effected, the resultant force FA will be directed above the water level since the watercraft will heel over to the left when executing a right hand turn. As a result of this, the horizontal and vertical components of the force FA will be such as to create a lift on the rear of the watercraft and a fairly large sideward thrust which will cause side slipping of the watercraft. In some instances this may not be the desired result.

Figure 6:
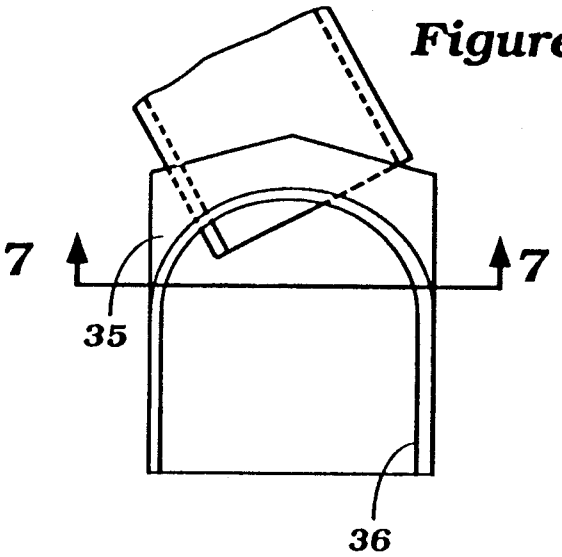
FIG. 6 is a top plan view of a steering nozzle constructed in accordance with an embodiment of the invention.
Figure 7:
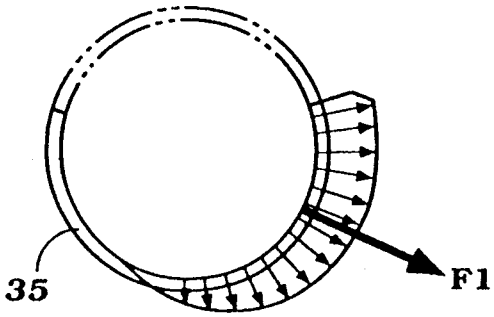
FIG. 7 is a cross sectional view taken along the line 7—7 of FIG. 6 and shows the distribution or forces during the steering movement.
Figure 8:
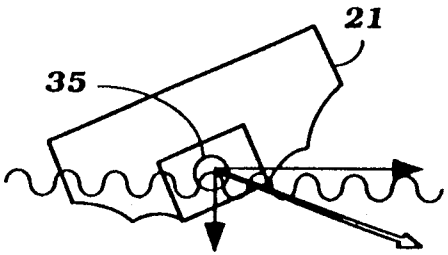
FIG. 8 is a side elevational view, in part similar to FIG. 5, showing the operation and forces in connection with this embodiment.

In accordance with the invention the configuration of the discharge opening of the steering nozzle 35 is configured differently so as to achieve different types of steering effects. For example, referring to FIGS. 6 through 9 and the specific shape of the discharge nozzle 35 as shown in FIGS. 1 and 2, it will be noted that the discharge nozzle 35 still has a generally cylindrical shape. However, the discharge opening 36 is cut off at an angle about a plane that is inclined forwardly in an upward direction. As a result, when a right hand turn is being effected as shown in FIGS. 6 through 8, the forces generated by the water on the nozzle 35 during its discharge will be directed more toward the lower portion of the nozzle to result in a resultant force FB that is directed below the water level even when the watercraft 21 heels over. As a result, the rear end of the hull 22 will tend to dig into the water and effect a sharper turn without side slipping.

Figure 10:
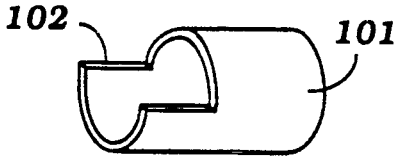
FIG. 10 is a perspective view of a steering nozzle constructed in accordance with another embodiment of the invention.

FIG. 10 shows another example of a discharge opening configuration for a steering nozzle that will tend to prevent side slipping and improve the down thrust during steering. In this embodiment, a steering nozzle 101 has a generally cylindrical configuration that is cut off by means of a cylindrical segment 102 so as to provide the desired side thrust.

Figure 11:
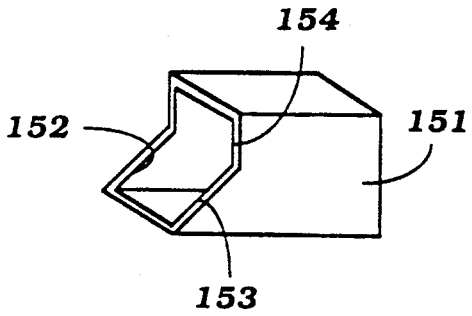
FIG. 11 is a perspective view of a steering nozzle constructed in accordance with still another embodiment of the invention.
Figure 12:
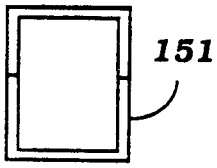
FIG. 12 is a rear elevational view of the steering nozzle of FIG. 11.
Figure 13:
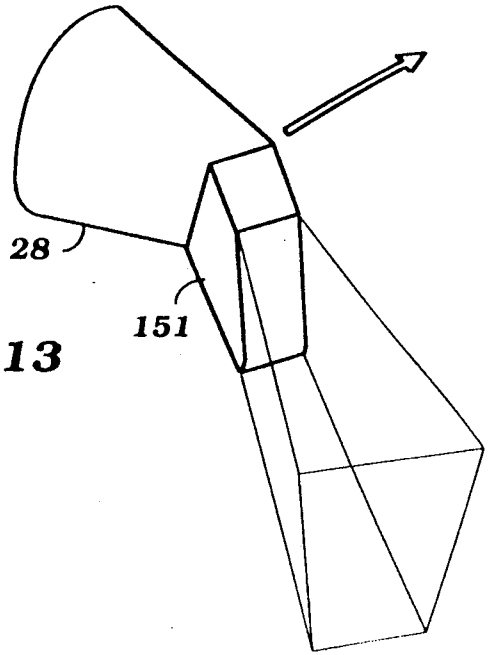
FIG. 13 is a perspective view showing the water distribution of the steering nozzle constructed in accordance with the embodiment of FIGS. 11 and 12.

FIGS. 11 through 13 show another embodiment of the invention wherein that provides the same type of effect wherein the discharge nozzle 151 has a generally rectangular configuration. The discharge opening 152 is formed by an inclined portion 153 and a vertically extending portion 154 so as to achieve the same type of result as aforenoted.

FIG. 13 shows the path of water discharge from this type of nozzle. It will be seen that the water discharge rather than being rectangular in configuration as would be true with a conventionally ended discharge nozzle to a discharge that tapers upwardly as it leaves the nozzle 151.

Figure 14:
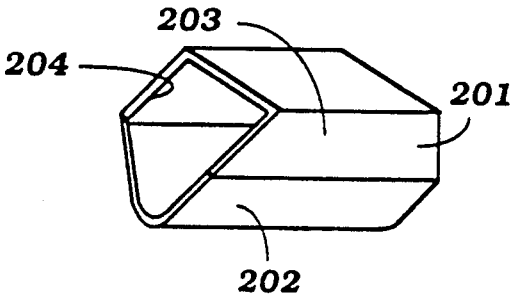
FIG. 14 is a perspective view of a steering nozzle constructed to accordance with a further embodiment of the invention.
Figure 15:
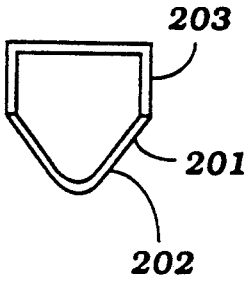
FIG. 15 is a rear elevational view of the embodiment of FIG. 14.

FIGS. 14 and 15 show yet another embodiment of the invention that will achieve that same type of result and which will provide even greater down forces. In this embodiment, the discharge nozzle 201 has a configuration that is comprised of a lower V-shaped section 202 and an upper rectangular shaped section 203. A discharge opening 204 is formed by cutting the V-shaped section along a vertically extending plane and the rectangular section 203 along a forwardly inclined plane.

Figure 16:
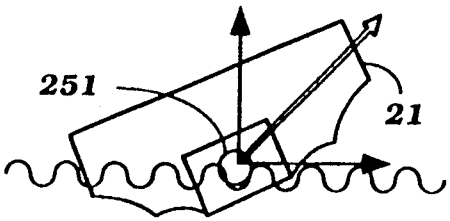
FIG. 16 is a rear elevational view in part similar to FIGS. 5 and 8 and shows another embodiment of the invention and type of effect that can be achieved by it.

In addition to reducing side slippage, the discharge nozzle may also be configured so as to increase the amount of side slipping if either the operator or the particular type of watercraft in question require this. As seen in FIG. 16 a discharge nozzle 251 is configured which may generally have a shape of any of the previously described nozzle ends except that they would be inverted. As a result, during right hand steering the side thrust FC has a even greater vertically upward component than the prior art type of constructions as shown in FIG. 5 and a greater amount of side slippage can be achieved.

It should be readily apparent from the described construction that the embodiments disclosed provide a variable type of side slippage and rear end thrust to suit the operator and watercraft requirements. Hence, greater versatility is possible than with the prior art construction. Although a number of embodiments of the invention have been illustrated and described, various changes and modifications may be made without departing from the prior and scope of the invention, as defined by the appended claims.

I claim:

1. A jet propulsion unit for propelling and steering a watercraft having a pumping unit for collecting water from an inlet and expelling it through a discharge, a steering nozzle pivotally supported adjacent said discharge and adapted to collect water discharged from said discharge and return it to the body of water in which said watercraft is operating, said steering nozzle being pivoted about a generally vertically extending steering axis, and means fixed against movement relative to said steering nozzle for generating a side force acting generally non perpendicularly to said steering axis upon said steering nozzle from the water flowing from said discharge only upon said steering nozzle being pivoted from the straight ahead position.

2. A jet propulsion unit as set forth in claim 1 wherein the side force is created by a difference in the shape of the outlet end of the steering nozzle from the shape of the inlet end.

3. A jet propulsion unit as set forth in claim 2 wherein the nozzle generates a force that is directed downwardly from a perpendicular line to the steering axis.

4. A jet propulsion unit as set forth in claim 2 wherein the nozzle is configured to provide a force that acts upwardly from the perpendicular to the steering axis.

5. A jet propulsion unit as set forth in claim 1 wherein the nozzle has a constant cross-sectional shape from its inlet end to adjacent its outlet end and the configuration of the outlet end is varied in side elevation.

6. A jet propulsion unit as set forth in claim 5 wherein the nozzle is generally cylindrical from its inlet end to adjacent its outlet end.

* * * * *